US007325269B2

(12) United States Patent
Hardy et al.

(10) Patent No.: US 7,325,269 B2
(45) **Date of Patent: *Feb. 5, 2008**

(54) SCRAPER BLADE INTERLOCKING ATTACHMENT APPARATUS AND METHOD

(75) Inventors: Benjamin Hardy, Elkorn, WI (US); Drew Van Norman, Whitewater, WI (US)

(73) Assignee: SPX Corporation, Charlotte, NC (US)

( * ) Notice: Subject to any disclaimer, the term of this patent is extended or adjusted under 35 U.S.C. 154(b) by 625 days.

This patent is subject to a terminal disclaimer.

(21) Appl. No.: 10/737,896

(22) Filed: Dec. 18, 2003

(65) Prior Publication Data

US 2005/0132516 A1 Jun. 23, 2005

(51) Int. Cl.
*F23J 3/00* (2006.01)

(52) U.S. Cl. ..... 15/104.068; 15/104.09; 15/104.13; 15/93.1; 415/130; 415/141

(58) Field of Classification Search ..... None
See application file for complete search history.

(56) References Cited

U.S. PATENT DOCUMENTS

| | | | | |
|---|---|---|---|---|
| 3,235,002 | A * | 2/1966 | Bachmann et al. | 165/94 |
| 3,385,354 | A * | 5/1968 | Bevarly | 165/94 |
| 3,848,289 | A * | 11/1974 | Bachmann | 15/246.5 |
| 4,073,339 | A * | 2/1978 | D'Orsay | 165/94 |
| 4,185,352 | A * | 1/1980 | Smith | 15/246.5 |
| 2004/0099405 | A1 * | 5/2004 | Hardy | 165/94 |

* cited by examiner

*Primary Examiner*—David Redding
(74) *Attorney, Agent, or Firm*—Baker & Hostetler LLP

(57) ABSTRACT

Attachment apparatus and method for interlocking attachment of a scraper blade with a drive shaft of a scraped surface heat exchanger includes a blade having dual attachment beams and a central locking member, and at least one pin having dual fingers each for interlocking with a respective attachment beam.

9 Claims, 4 Drawing Sheets

SCRAPER BLADE INTERLOCKING ATTACHMENT APPARATUS AND METHOD

FIELD OF THE INVENTION

The invention pertains to the field of process equipment. More particularly, the invention pertains to the attachment of blades to a rotating drive shaft, such as for example in scraped surface heat exchangers.

BACKGROUND OF THE INVENTION

Scraped surface heat exchangers are a type of mixing apparatus well known in industry. Scraped surface heat exchangers generally feature an outer cylindrical housing tube and a central rotatable drive shaft disposed in the center of the outer housing tube. An annular space is provided between the central drive shaft and the outer housing tube, and material is forced from one end of the scraped surface heat exchanger through the annular space between the tubes.

In general, the material enters the space between the tubes near one end of the scraped surface heat exchanger and travels longitudinally along the scraped surface heat exchanger and exits near the other end of the scraped surface heat exchanger. During this time, the material can be mixed by blades which are attached to, and extend outward from, the central shaft and are rotated by the central shaft. The material may also be subject to temperature gradients as it travels along the scraped surface heat exchanger so that the material is heated or cooled.

The blades are sometimes very generally flat blades which are mounted in a pivotable fashion proximate to the surface of the central drive shaft. The blades extend outward at a relatively narrow angle from the central drive shaft and generally have a tip feature at their distal end which is in sliding contact with the inner surface of the outer housing cylinder as the blades are rotated.

The blades are generally elongated, and typically several blades are provided along the length of the scraped surface heat exchanger to occupy the length of the inner volume of the scraped surface heat exchanger. The blades serve at least some of several functions. For example, the blades can enhance overall mixing of the material as it passes along the inner volume of the scraped surface heat exchanger. The blades also can contact the inner housing of the scraped surface exchanger to in effect scrape material off the inner surface so that it does not build up on the inner surface of the housing cylinder. Further, the blades can add to general flow patterns within the heat exchanger which facilitate temperature transfer from the outer housing of the heat exchanger to the material itself. The outer housing may have a fluid jacket or other heating or cooling source to impart a desired temperature to the outer housing, so that the material can be heated or cooled as it travels through the device.

It has been known to mount the blades to the central driving shaft using so-called "pins". The pins are individual items that are attached, usually by welding, to the drive shaft surface and have some sort of receptacle area to accept a part of the blade so the blade is pivotally positioned. Two or more pins are usually used on the length of a single blade to pivotally support one blade at the locations of the pins. Previously, the blades have had a cutaway portion forming a hinge shaft or single "attachment beam" that is received in the receptacle slot of the pin to form a hinge configuration.

As noted above, the pins are typically spaced apart longitudinally along the length of the drive shaft, with two or more pins being used for each blade. For simplicity and manufacturing costs reasons, for a given length of heat exchanger it is typically desirable to reduce the number of blades and even further to reduce the number of pins. Thus, it is desirable typically to use relatively longer blades if possible, and it would be desirable to reduce the number of pins for each blade as well.

However, there can be some drawbacks to using longer blades and fewer pins when using the aforementioned prior art pin connection methods. In the prior art, the blades have tended to have relatively short attachment beams due to shear and buckling failure modes. Due to the possibility of flexing of the entire blade between the attachment points, there is a need to place the beams and pins at certain regularly defined intervals.

Another disadvantage with at least some conventional pin and beam attachment systems has been that during assembly of the device, the blade may fall out of its pin receptacle depending on the manufacturing angle of the shaft, pin, and blade.

Accordingly, there is a need in the art for a blade attachment apparatus and method that can overcome the above advantages in some instances, at least to some extent, for example by providing desirable support to the blade as well as by providing some degree of locking of the blade to prevent it from falling out during installation, while permitting some pivoting during assembly and operation.

SUMMARY OF THE INVENTION

The foregoing needs are met, to a great extent, by the present invention, wherein in one aspect an apparatus is provided that in some embodiments provides pivotal attachment of a blade to a drive shaft of a device such as a scraped surface heat exchanger.

In accordance with one embodiment of the present invention, a pin for attaching a blade to a drive shaft of a scraped surface heat exchanger, comprises a base portion including a first flat surface facing away from the shaft, and at least one hook-shaped arm extending upwardly from the base and having a second flat surface generally perpendicular to the first flat surface of the base, said arm also having a concave surface extending from the second surface and generally opposed to and facing the first surface.

In accordance with another embodiment of the present invention, a blade for use with a scraped surface heat exchanger having a drive shaft with at least one pin, comprises a locking member with foot having a cam surface, and at least one attachment beam, wherein the attachment beam is adapted to be inserted into the pin and rotation of the blade causes the attachment beam to be retained by the pin due to contact of the cam surface of the foot with a first surface of the pin.

In accordance with yet another embodiment of the present invention, a blade attaching system for use with a scraped surface heat exchanger having a drive shaft comprising at least one pin comprises a base portion including a first flat surface facing away from the shaft; and at least one hook shaped arm extending upwardly from the base and having a second flat surface generally perpendicular to the first flat surface of the base, the hook also having a concave surface extending from the second surface and generally opposed to and facing the first surface, and a blade having a locking member including a foot having a cam surface, and at least one attachment beam, wherein the attachment beam is adapted to be inserted into the pin and rotation of the blade causes the attachment beam to be urged upward into the concave region by contact of the cam surface of the foot with the first surface of the pin.

In accordance with yet another embodiment of the present invention, a pin for attaching a blade to a drive shaft of a scraped surface heat exchanger, comprises means for mounting the pin to the drive shaft, including a first flat surface facing away from the shaft, and means for pivotally retaining the blade to the drive shaft, extending upwardly from the base and having a second flat surface generally perpendicular to the first flat surface of the base, the retaining means also having a concave surface extending from the second surface and generally opposed to and facing the first surface.

In accordance with yet another embodiment of the present invention, a blade for use with a scraped surface heat exchanger having a drive shaft with at least one pin, comprises a foot having means for camming on the pin, and at least one means for pivotally connecting with the pin that is adapted to be inserted into the pin and rotation of the blade causes the connecting means to be urged upward into a concave region of the pin by contact of the caming means of the foot with a first surface of the pin.

In accordance with yet another embodiment of the present invention, a blade attaching system for use with a scraped surface heat exchanger having a drive shaft, comprises at least one pin comprising means for mounting the pin to the drive shaft including a first flat surface facing away from the shaft and means for pivotally retaining the blade to the drive shaft extending upwardly from the base and having a second flat surface generally perpendicular to the first flat surface of the base, the retaining means also having a concave surface extending from the second surface and generally opposed to and facing the first surface, and a blade having means for locking the blade in pivotal connection with the pin, including a foot, having a cam surface, and at least one attachment beam, wherein the attachment beam can be inserted into the pin and rotation of the blade causes the attachment beam to be urged upward into the retaining means by contact of the cam surface of the foot with the first surface of the pin.

In accordance with yet another embodiment of the present invention, a blade attaching method for use with a scraped surface heat exchanger having a drive shaft, comprises providing at least one pin mounted to the drive shaft including a first flat surface facing away from the shaft, pivotally retaining the blade to the drive shaft using the pin via a second flat surface generally perpendicular to the first flat surface of the base, and a concave surface extending from the second surface and generally opposed to and facing the first surface, and locking the blade in pivotal connection with the pin, the blade including a foot, having a cam surface, and at least one attachment beam, by inserting the attachment beam into the pin and rotating the blade so that the attachment beam is urged upward into the concave surface by contact of the cam surface of the foot with the first surface of the pin.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figures 1, 2:
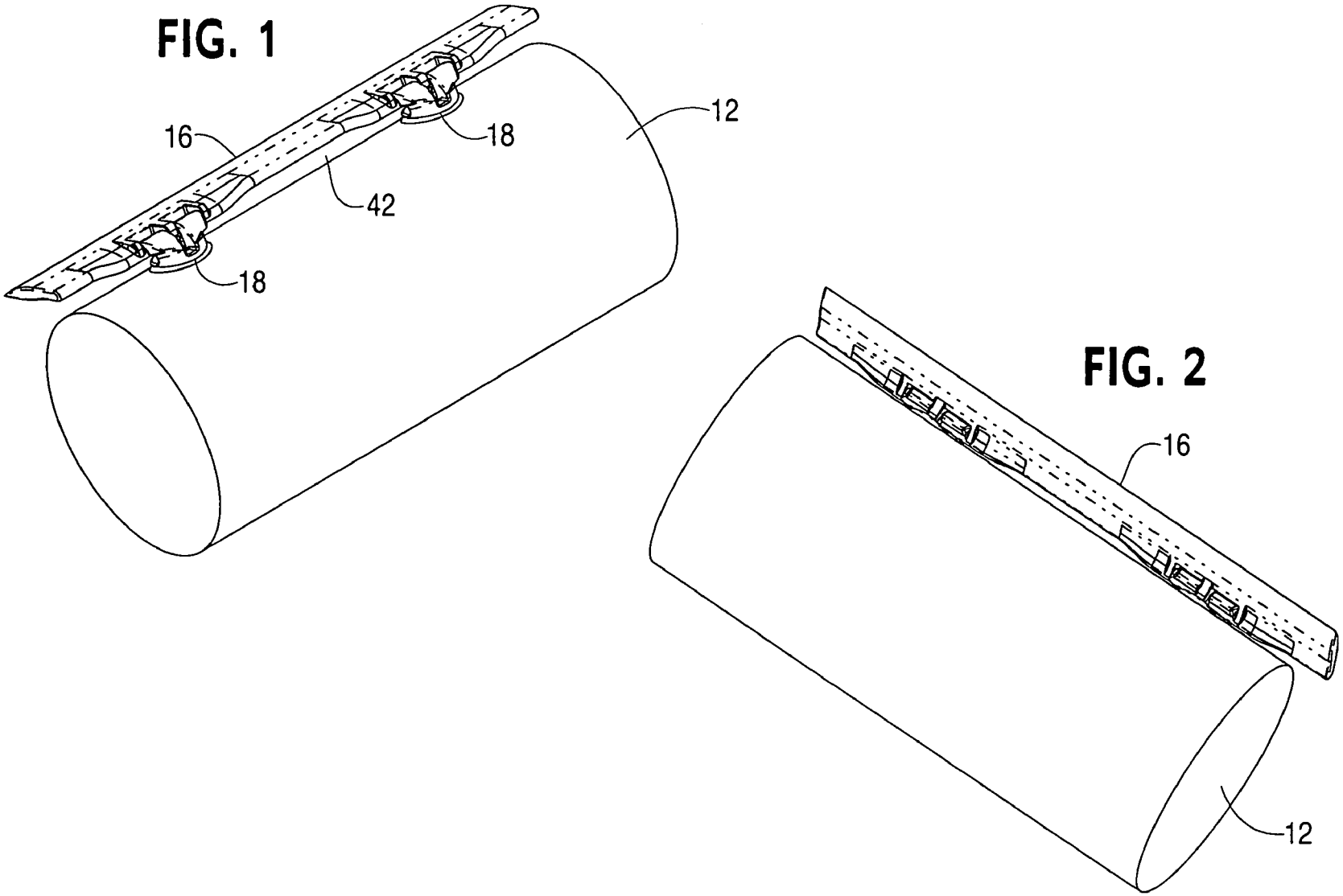
FIG. 1 is a perspective view of a portion of a scraped surface heat exchanger drive shaft using pins for attachment of a blade.
FIG. 2 is a perspective view of the items of FIG. 1 taken from a different angle.
Figure 3:
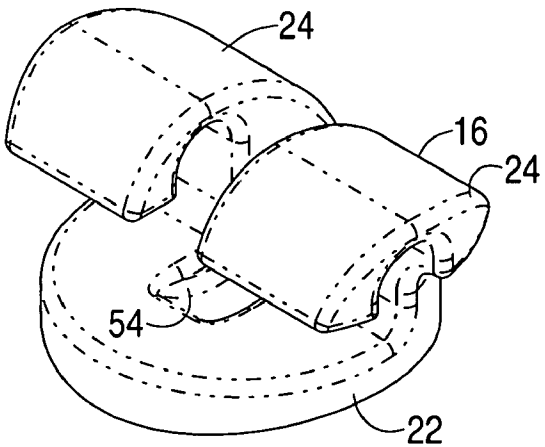
FIG. 3 is a perspective view of a mounting pin according to a preferred embodiment of the invention.

Preferred embodiments of the invention provide pivotal attachment of a blade to a drive shaft of a device such as a scraped surface heat exchanger. The invention will now be described with reference to the drawing figures, in which like reference numerals refer to like elements throughout.

Figure 10:
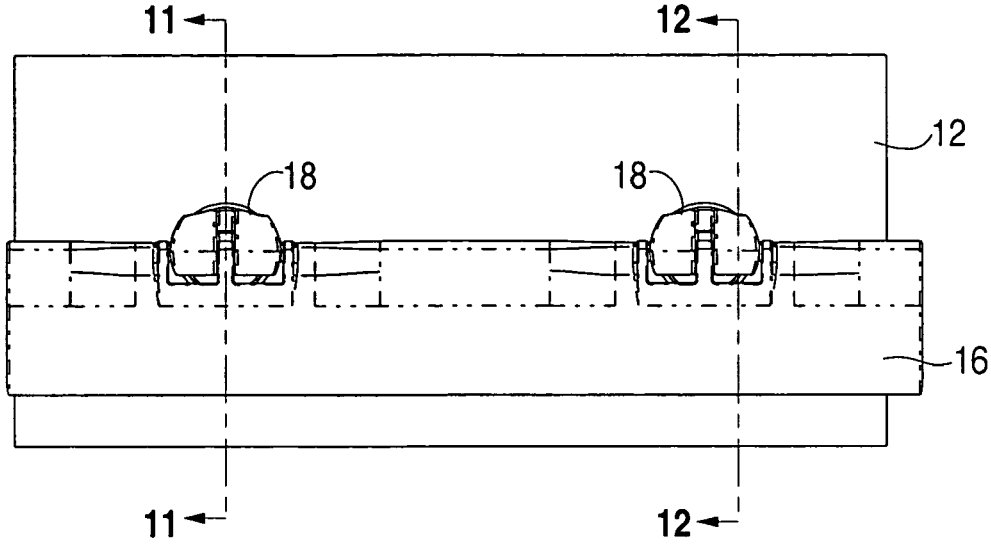
FIG. 10 is a top view of a blade, pins and a portion of a drive shaft in a fully installed and operating orientation.
Figure 11:
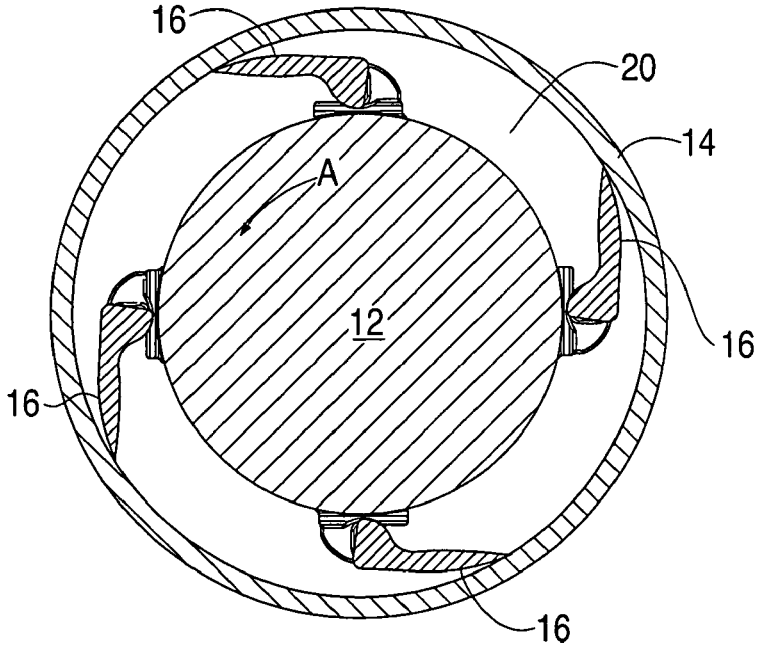
FIG. 11 is a cross sectional view taken through line 11--11 in FIG. 10, further showing an outer housing tube.

Turning to FIGS. 1, 2 and 11 initially, some components of a scraped surface heat exchanger are illustrated including a central drive shaft 12 which is powered for rotating motion, a stationary cylindrical outer housing tube 14 (seen in FIG. 11) which surrounds either concentrically or eccentrically the drive shaft 12, and a blade 16 which is mounted to the shaft by two mounting pins 18. FIGS. 1 and 2 as well as FIGS. 7 and 10 of this description for convenience and simplicity illustrate a single blade 16 mounted to a portion of a shaft 12 of the scraped surface heat exchanger. However, there are preferably several blades 16 at even circumferential angles around the shaft 12 as illustrated for example by the four blades 16 in FIG. 11.

A space 20 is provided between the drive shaft 12 and the inner surface of housing tube 14 through which material passes longitudinally along the length of the scraped surface heat exchanger and travels along the longitudinal axis of the shaft 12 and the housing 14. As the material moves through the space 20, it is scraped and/or mixed by the blade 16 due to rotation of the shaft 12.

The operative direction of rotation of the shaft 12 in FIG. 11 is shown by the arrow A. It will be appreciated that as the material resists the motion being imparted by the blade 16, the material tends to urge the blades 16 outward and into sufficiently firm scraping contact with the inner surface of the housing tube 14. The housing tube 14 will usually be heated or cooled as known in the art of scraped heat exchangers, for example by having a fluid cooling or heating jacket or other type of heating or cooling element associated therewith.

FIGS. 3-6 illustrate preferred pin 16 in more detail. The preferred pin 16 features a base 22 which has a curved bottom as shown for attachment to the outer surface of the central drive shaft 12. The pin 18 is typically welded to the drive shaft 12 but may be attached by other affixing types. The pin 18 also features two relatively wide generally hook-shaped fingers 24 which can preferably together extend a width greater than the width of the base 22. The fingers 24 have an interior edge shape that forms a receptacle 26 that interacts with various features of the blade 16 as described in more detail below. Specifically, the receptacle 26 has a lower edge 28, a side edge 30 and a generally semi-circular concave portion 32 which is defined by the interior or underside surface of the hook portion 34 of the pin 18.

Figure 7:
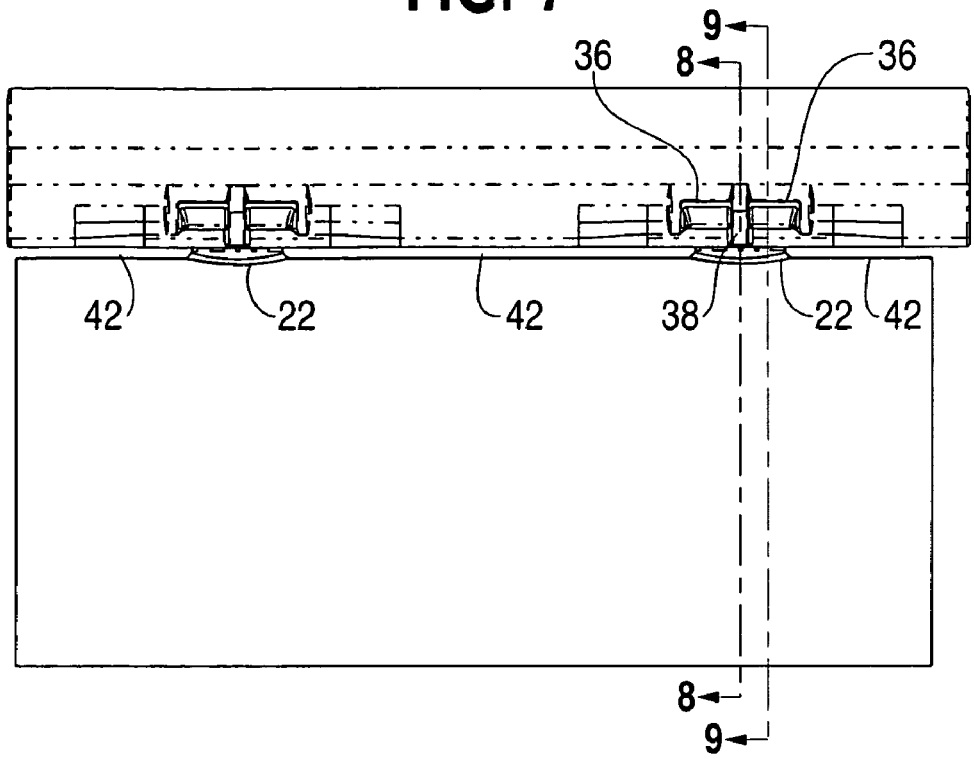
FIG. 7 is a side view of a portion of a drive shaft and scraped surface heat exchanger, showing mounting pins and a blade during the installation process.
Figure 8:
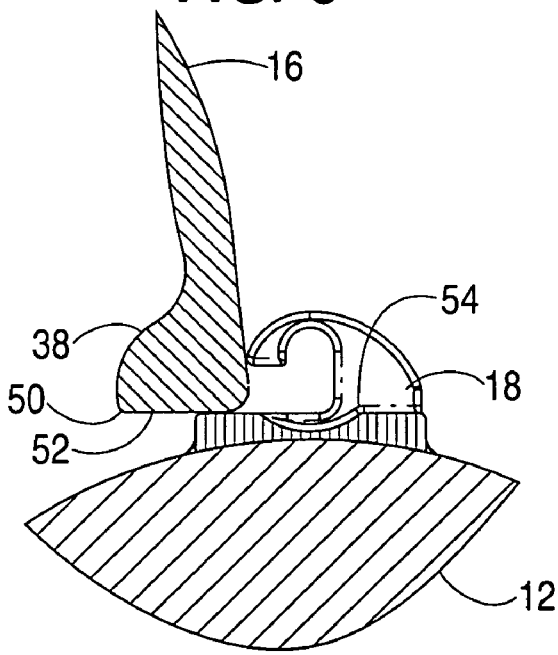
FIG. 8 is a cross sectional view taken through line 8--8 in FIG. 7.
Figure 9:
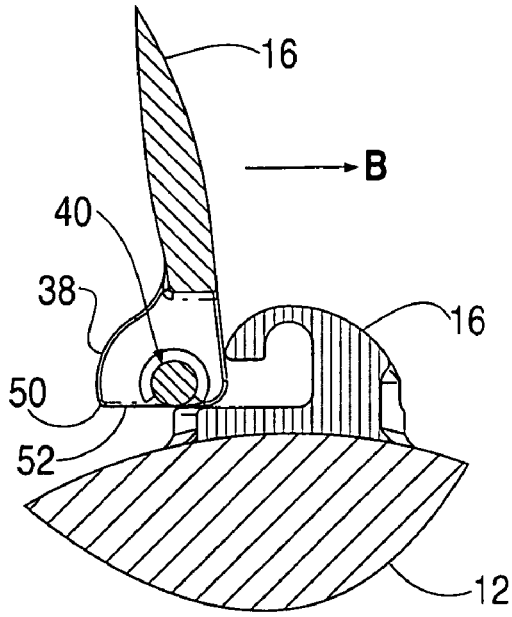
FIG. 9 is a cross sectional view taken through line 9--9 in FIG. 7.

Turning to FIGS. 7-12, the interaction of a blade 16 with the pins 18 is illustrated. As seen in FIGS. 7, 8, and 9, the blade 16 has at a location corresponding to each pin 18 a pair of cut-out areas 36 on either side of a central locking member 38 extending outward from each side of the central supporting and locking member 38 to the other side of the cut-out 36 on each side is a respective attachment beam 40. Thus, each pin 18 is associated with a pair of attachment beams 40, also referred to as dual attachment beams 40, each associated with a respective cut-out 36. In between the two cut-outs 36 is a central locking member 38 which serves to provide support to the attachment beams 36, and which also interacts with the pin 11 to lock the blade in place during operation, and to retain the attachment beams 36 in the concave area 32 of each pin 16 as described in more detail below. The locking member 38 can also be referenced to as a locking disc 38. Also, the word cut-out does not imply manufacturing by cutting or any particular method but refers to the shape of the feature.

Looking particularly at FIGS. 7 and 10, it will be appreciated that in the illustrated embodiment a single pin having a base of a certain size is able to provide an effective support area for the blade which may be considered to be wider than the base of the pin 18 itself. Moreover, the provision of the central locking member 38 serves not only a locking function but also gives support to the attachment beams 40 to prevent flexing of the blade 16 as a whole, as well as flexing of the beams 40 within the concave region 32 of the pin 18 itself. Thus, the preferred embodiment in some instances facilitates the use of fewer pins 18 for a given length of blade 16 than was required in the prior art.

The use of fewer pins 18 for a given length of blade 16 provides significant advantages in some circumstances. For example, the cost of fixing each pin 18 to the central shaft 12 is reduced. Moreover, a larger free area 42 (the area under the blade not interfered with by the base 22 of each pin 16) is further provided than would be available if more pins 18 were needed. Providing this larger free area 42 facilitates flow of the material under the blade which can enhance mixing flow properties and also reduce the force needed to drive the central shaft drive.

Another benefit of providing dual attachment beams 40, as opposed to a single attachment beam having the same effective length as the two attachment beams, is that with the dual beams 40, each beam 40 is relatively shorter and less susceptible to bending and buckling failure. Further, the central locking element 38 provides further stiffening due to its thickness.

Figure 6:
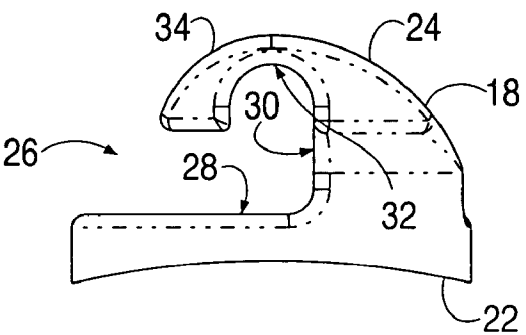
FIG. 6 is a side view of the pin of FIG. 3.
Figure 4:
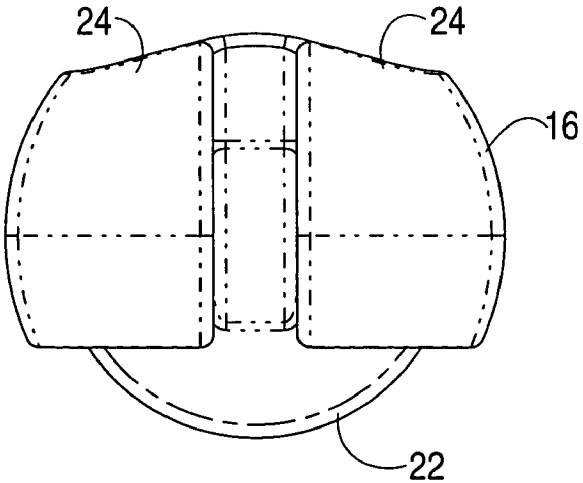
FIG. 4 is a top view of the pin of FIG. 3.
Figure 5:
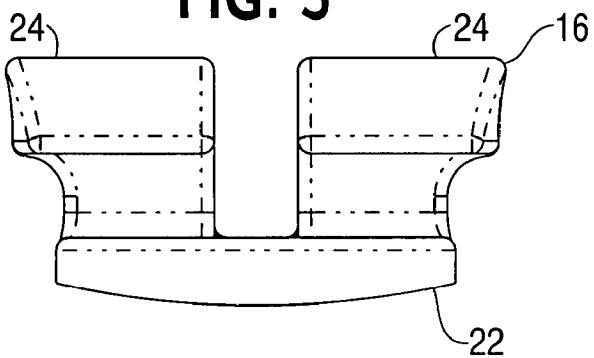
FIG. 5 is a front view of the pin of FIG. 3.

The method of installation of a blade 16 to a pin 18 will now be described in more detail with particular respect to FIGS. 6, 9 and 8. FIG. 9 illustrates the blade 16 in a configuration just at the beginning of the assembly process. The blade 16 is extending generally completely radially outward from the central drive shaft 12. In order to accomplish this arrangement, the drive shaft 12 has been removed from the outer housing 14, since when the drive shaft 12 is within the outer housing 14, the blade 16 cannot be positioned at this angle. The blade 16 has a pair of locking beams 40 extending from either side of the central locking feature 38. The central locking feature 38 has a lower cam corner 50 and a flat foot 52 as shown.

Figure 12:
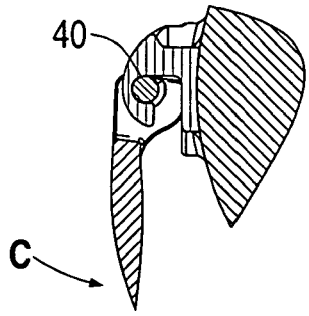
FIG. 12 is a cross sectional view taken through line 12--12 in FIG. 10 showing the blade in the configuration also shown in FIG. 11.

Initially, as in FIG. 9, the blade 16 is held in the generally vertical orientation and is slid in the direction shown by the arrow B. The foot 52 is generally flat and slides in the generally flat relationship along the surface 28 (FIG. 6) of the pin 18. Once it has been fully inserted so that the attachment beam 40 is resting in the corner between the surfaces 28 and 30 of the pin 18, the blade 16 is rotated in the direction shown by arrow C in FIG. 12 until it reaches substantially of the orientation shown in FIG. 12. As can be seen in FIG. 12, the attachment beam 40 is now urged into a pivoting but otherwise retrained relationship so that the surface of the attachment beam 40 is resting in the concave portion 32 (FIG. 6) of the pin 16.

The interaction of the foot 38 and the cam corner 50 with the surface 28 of the pin 16 serves to translate the attachment beam 40 upward from its position in FIG. 9 to its eventual position as shown in FIG. 12. Moreover, the interaction of the foot 38, and cam corner 50, serves to hold the pin 40 in this position so long as the blade 16 is angled substantially as shown in FIG. 12. In some embodiments it may be preferable to provide a small saddle 54 in the portion of the pin 18 between the arms 24 (see FIGS. 3 and 8). This saddle 54 receives the cam corner 50 and foot 38 to facilitate angular motion during installation and to permit a degree of angular motion during the operative position as shown in FIG. 12.

The position shown in FIG. 12 permits the shaft 12 and associated blades 16 to be installed within the outer housing 14 as generally shown by FIG. 11. When in the installed state shown in FIG. 11, the blade 16 is prevented from rotating in a direction opposite to the direction shown by arrow C in FIG. 12. A benefit of the locking arrangement using the central locking feature 38 having a cam corner 50, and foot 52, is that the blades 16 can be easily installed, but once they are pivoted in the direction shown by arrow C in FIG. 12 to a sufficient extent, they are restrained until they are rotated oppositely by a significant amount. This can facilitate the assembly of blades 16 onto a shaft 12 during the assembly process, because the shaft 12 and associated pins 18 can be at relatively wide range of angles, without the blades 16 being able to fall off their respective pins 18.

The blades, pins and shafts may of any suitable materials as desired. In some preferred heat exchangers, the drive shaft 12 is stainless steel and the pins 18 are stainless steel items welded on to the shaft. The blade 16 is preferably made from a nonmetallic material in order to facilitate forming of desired blade shapes, and preferred blade materials include molded plastics such as Victrex PEEK (polyaryletheretherketone) or Ticona Celcon (acetyl copolymer). Alternatively, the blade can be for example a pressed metal such as stainless steel. A benefit of some embodiments of the present invention, is that the elongated dual attachment beams 40 can be provided, and due to the provision of the central supporting element 38 it can have a desirably long effective supporting length without being subjected to such stress that a metal strengthening insert would necessarily be required. However, the locking feature of some embodiments of some invention does not require that there be dual attachment beams with the locking feature provided on a central element. For example, alternative embodiments can include a single attachment beam extending across a single cutout. A locking feature including a foot 52, and a cam corner 50 may be provided at any location along the blade, most preferably in such an embodiment adjacent to one side of the cutout to interact with a corresponding feature on the pin. In such an embodiment, a single finger would preferably be used with a single beam, and of the saddle 56 if provided would be located to the side of the respective finger, rather than centrally between two fingers as shown in the embodiment of FIGS. 1-11.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A blade attaching system for use with a scraped surface heat exchanger having a drive shaft comprising:

at least one pin comprising a base portion including a first flat surface facing away from the shaft; and at least one hook shaped arm extending upwardly from the base and having a second flat surface generally perpendicular to the first flat surface of the base, the hook also having a concave surface extending from the second surface and generally opposed to and facing the first surface; and a blade having a locking member including a foot having a cam surface, and at least one attachment beam, wherein the attachment beam is adapted to be inserted into the pin and rotation of the blade causes the attachment beam to be urged upward into the concave region by contact of the cam surface of the foot with the first surface of the pin.

2. A blade attaching system according to claim 1, wherein the pin has two of the hook-shaped arms.

3. A blade attaching system according to claim 1, further comprising a saddle indentation on the base.

4. A blade attaching system according to claim 1, wherein the concave surface is adapted to pivotally receive an attachment beam of the blade.

5. A blade according to claim 1, wherein the blade has two of the attachment beams, associated with a single pin.

6. A blade according to claim 1, wherein the locking member is located between the two attachment beams.

7. A blade attaching system for use with a scraped surface heat exchanger having a drive shaft, comprising:

at least one pin comprising means for mounting the pin to the drive shaft including a first flat surface facing away from the shaft and means for pivotally retaining the blade to the drive shaft extending upwardly from the base and having a second flat surface generally perpendicular to the first flat surface of the base, the retaining means also having a concave surface extending from the second surface and generally opposed to and facing the first surface; and a blade having means for locking the blade in pivotal connection with the pin, including a foot, having a cam surface, and at least one attachment beam, wherein the attachment beam can be inserted into the pin and rotation of the blade causes the attachment beam to be urged upward into the retaining means by contact of the cam surface of the foot with the first surface of the pin.

8. A blade attaching method for use with a scraped surface heat exchanger having a drive shaft, comprising:

providing at least one pin mounted to the drive shaft including a first flat surface facing away from the shaft;

pivotally retaining the blade to the drive shaft using the pin via a second flat surface generally perpendicular to the first flat surface of the base, and a concave surface extending from the second surface and generally opposed to and facing the first surface; and locking the blade in pivotal connection with the pin, the blade including a foot, having a cam surface, and at least one attachment beam, by inserting the attachment beam into the pin and rotating the blade so that the attachment beam is urged upward into the concave surface by contact of the cam surface of the foot with the first surface of the pin.

9. A method according to claim 8, wherein the blade has two cam surfaces each corresponding with one pin or the drive shaft.

* * * * *